US008657128B2

(12) United States Patent
Coyne et al.

(10) Patent No.: US 8,657,128 B2
(45) Date of Patent: Feb. 25, 2014

(54) GOLF CLUB HOLDER

(76) Inventors: Matthew David Coyne, Pompano Beach, FL (US); Michael Charles Landi, Coral Springs, FL (US)

( * ) Notice: Subject to any disclaimer, the term of this patent is extended or adjusted under 35 U.S.C. 154(b) by 223 days.

(21) Appl. No.: 13/199,306

(22) Filed: Aug. 25, 2011

(65) Prior Publication Data

US 2013/0048585 A1 Feb. 28, 2013

(51) Int. Cl.
*A63B 55/00* (2006.01)

(52) U.S. Cl.
USPC ..... 211/70.2

(58) Field of Classification Search
USPC ..... 211/70.2, 60.1, 70.8, 62; 248/96; 206/315.2, 315.3, 315.6, 315.7; 473/282
See application file for complete search history.

(56) References Cited

U.S. PATENT DOCUMENTS 2,970,629 A * 2/1961 Masten ..... 206/315.2
2,992,012 A * 7/1961 Herold ..... 280/47.19
3,164,185 A * 1/1965 Ingoldt ..... 294/159
3,866,646 A * 2/1975 Nevard ..... 211/70.2
3,966,051 A * 6/1976 Hollister et al. ..... 211/14
4,778,141 A * 10/1988 Bogar ..... 248/538
4,834,444 A * 5/1989 Young ..... 294/143
4,934,550 A * 6/1990 Cash ..... 220/484
5,076,581 A 12/1991 Boberg
D326,771 S * 6/1992 Bukovac ..... D3/320
5,135,107 A * 8/1992 Ingraham ..... 206/315.6
5,314,079 A * 5/1994 Young ..... 211/70.2
5,425,452 A * 6/1995 Shanks et al. ..... 206/315.7
5,573,122 A * 11/1996 Williams ..... 211/70.2
5,669,514 A 9/1997 Massetti
5,704,847 A 1/1998 Glennon
6,216,864 B1 * 4/2001 Chang ..... 206/315.2
6,315,133 B1 11/2001 Franke
6,345,722 B1 * 2/2002 Wingate ..... 211/70.2
6,405,891 B1 * 6/2002 Christensen et al. ..... 220/484
6,471,055 B1 10/2002 Kwiecienski
D472,598 S 4/2003 Lawrence
6,572,487 B1 6/2003 Ruff
D476,479 S 7/2003 Bailey
6,640,970 B1 * 11/2003 Townsend, Jr. ..... 206/315.2
D486,875 S 2/2004 Hale et al.
D505,174 S 5/2005 Thomas, Sr.
6,962,536 B2 11/2005 Hall et al.
6,964,618 B2 11/2005 Klein
D520,098 S 5/2006 LeMoine
D529,977 S 10/2006 Chappell
D530,768 S 10/2006 Rood
7,284,659 B2 * 10/2007 Sugarek et al. ..... 206/315.6
D564,614 S 3/2008 Valiante (Continued)

*Primary Examiner* — Jonathan Liu
*Assistant Examiner* — Patrick Hawn

(57) ABSTRACT

An improved golf club holder having a base, tubular casings, and pins. The base has a plurality of openings. The tubular casings are attached to the underside of the base at each plurality of openings. A golfer can insert a golf club into an opening in the base and allow the club to move down through the shaft of the tubular casing until the butt of the golf club rests upon a pin. Resting upon a pin, the golf club will stand vertically in the tubular casing shaft. This golf club holder differs in that it is an immobile apparatus fixed at ground-level by compression of ground to a golf course. Therefore, a golfer will not need to purchase their own golf club holder, transport it to and from the cart, insert a sharp object into the ground, bend to utilize, or attach it to a golf bag.

1 Claim, 7 Drawing Sheets

(56) References Cited

U.S. PATENT DOCUMENTS

| | | | | |
|---|---|---|---|---|
| D600,300 | S | 9/2009 | Wilson, II | |
| 7,611,421 | B2 | 11/2009 | Brewer et al. | |
| 7,841,051 | B2 | 11/2010 | Kushner | |
| 7,854,664 | B1 | 12/2010 | Comrie | |
| 7,857,150 | B2 * | 12/2010 | Young | 211/70.2 |
| 2008/0006547 | A1 * | 1/2008 | Pace | 206/315.2 |

* cited by examiner

GOLF CLUB HOLDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field

This invention generally relates to golf, specifically to providing a golf course with an immobile apparatus fixed at ground-level by compression of ground for holding a golf club in an upright position.

2. Prior Art

Club selection in golf is an integral part of the game. During any round of golf, a golfer will inevitably find themselves with more than one club in hand. Whether it be in the tee box of a par 3, in a sand trap, around a green, or on a green, it is common for a golfer to have more than one club in hand while standing over a ball making a decision on the shot to be played. Once the club of choice has been determined, a golfer needs to discard the remaining club(s). For the most part, the discarding of club(s) has equated to placing the golf club(s) on the ground. This practice has the following negative consequences: golf clubs being left behind and the time-consuming need to retrieve forgotten clubs; golf clubs being lost and the costly need to replace lost clubs; golf club grips becoming wet and the need to dry the grips; golf clubs being hit by balls in play and the need to replace one's golf ball in original position; constant bending to gather clubs lying on the ground and the battle with fatigue and risk of injury. Extensive prior art for resolving the practice of placing golf clubs on the ground fall into two main categories: (1) providing a apparatus to elevate a club off the ground and (2) providing a stand to which a club may lean against or be attached.

Prior art that elevate the club off the ground include:

U.S. Pat. No. 5,076,581—Dec. 31, 1991-William Boberg—A prop for spacing a handgrip of a golf club from the ground such that when the golf club is laid thereupon, the handgrip remains dry and clean, is provided.

U.S. Pat. No. 5,704,847—Jan. 6, 1998—Edward Glennon—A one-piece rectangular card-like member formed of a flexible plastic material has a plurality of concave notches formed in side and end edges of the card for receiving a shaft of a golf club therein to support the grip end of the club off the ground when the card is extending vertically.

U.S. Pat. No. 6,315,133—B1 Nov. 13, 2001—James Franke—A golf club support casing for supporting the grips of golf clubs above the ground.

U.S. Pat. No. 6,964,618—Filed Apr. 19, 2004—Roger Allen Klein—A rigid or semi-rigid, one-piece, shaped, planar golf club shaft support is provided for supporting the grip of a golf club above wet ground and/or grass on the golf course. The support has at least one lead-in entry and circular cutout positioned opposite an essentially flat base edge for receiving a golf club shaft. When the support is placed on the ground with the cutout containing the shaft upward and the base edge sitting on the ground, the grip end of the shaft is securely supported above the wet ground and/or grass and stays dry, and the club head rests on the ground to form a very stable support system that cannot be overturned or dislodged easily.

U.S. Pat. No. 7,611,421 B2—Nov. 3, 2009—Samuel Brewer, Edward Kline—A golf club handgrip elevation casing is provided which maintains the handgrip of the golf club off of the ground when the club is placed on the ground. The invention includes an opening in a receiving section into which the club is placed and includes a gripping section for holding golf club.

Prior art that provide a stand for golf clubs include the following.

Design Patents of ornamental design for a golf club holder:

Patent D472598 Golf Club Holder Apr. 1, 2003 Richard Lawrence

Patent D476479 Tube Holder for Golf Putter Jul. 1, 2003 Vance Bailey

Patent D486875 Auxiliary Golf Club Holder Feb. 17, 2004 Franklin C. Hale and James W. Austin Patent D505174 Golf Club Support May 15, 2005 Robert Allen Thomas Sr Patent D520098 Golf Club Holder May 2, 2006 William D. Lemoine Patent D529977 Golf Club Holder Oct. 10, 2006 William Chappell Patent D530768 Golf Club and Towel Holder Oct. 24, 2006 Clair T. Rood Patent D564614 Golf Club Apparatus Mar. 18, 2008 Nicholas Valiante Patent D600300 Self Standing Golf Support Sep. 15, 2009 Jonathan E. Wilson II Utility Patents:

U.S. Pat. No. 5,669,514—Sep. 23, 1997—Joseph Massetti—A compact holder for golf clubs which can be easily taken apart and stored in a player's pocket when not in use. When used by the player, the golf clubs are firmly held by the holder and can be used in a standing up position with the golf club heads resting on the ground or with a spike.

U.S. Pat. No. 6,471,055—Filed May 24, 2002—Richard E. Kwiecienski—A golf club carrier includes a central support that forms one of three legs that support the carrier when in use. The two other legs are provided by bending a flexible and resilient rod at its mid-point and pivotally interconnecting the rod at that mid-point to an upper end of the central support.

U.S. Pat. No. 6,572,487—Jun. 3, 2003—Thomas Ruff—A unitary golf club rest includes a golf club support at one end and a turf piercing element at the other end. A foot press is situated between the two ends. The golf club support is roughly V-shaped with a cushioned surface, and also acts as a handle for the golf club rest.

U.S. Pat. No. 6,962,536—Nov. 8, 2005—Jeffrey Hall and Paul Hebert—A compact golf accessory which may function as a cigar holder, golf club rest or golf ball retriever.

U.S. Pat. No. 7,854,664—Filed Apr. 16, 2009—Ronald Comrie—A golf club supporting accessory comprising a stake wherein the stake has a pointed end for insertion into ground; wherein the stake has a grip about a top end; wherein the grip has a hook upon which a golf club grip is able to interact in order to support the golf club.

U.S. Pat. No. 7,841,951—Nov. 30, 2010—Gary Kushner—A golf club caddy apparatus allows for the convenient transportation and support, of golf clubs and golf accessories around a golf course putting green or practice tee. The apparatus retains one or more golf clubs in a secure and convenient manner to facilitate play around a putting green of practice tee.

U.S. Pat. No. 7,854,664—Dec. 21, 2010—Stephen Blau—The golf club supporting accessory that supports a golf club when not in use and includes a cigar holder, towel holder, and Velcro strip for hanging a glove. The golf club supporting accessory has a stake as the main frame, which is struck into the ground.

The above aforementioned inventions, albeit all useful and effective, still collectively have disadvantages to be resolved. These issues include: casing needing to be transported with golfer; casing having a sharp, pointed, grounding mechanism that is dangerous; casing needing to be setup and/or placed on golf course; casing needing to be attached and/or stored in golf bag; casing requiring bending to pick up; and casing requiring purchase by golfer.

Thus, several advantages of our apparatus include: apparatus is an immobile structure fixed below ground-level by the compression of the ground of the golf course and therefore available for all golfers; apparatus has no sharp mechanisms that golfer needs to carry and insert into ground; apparatus does not have to be setup by the golfer to be utilized; apparatus does not have to be attached to or carried in a golf bag; apparatus requires no bending or fatigue developing motions; and apparatus is of no expense to the golfer.

SUMMARY

The primary objective of this invention is to provide an apparatus that is an immobile structure fixed below the ground-level by the compression of the ground that has casings to house golf clubs in an upright position.

DRAWINGS

Figures

Reference Numerals

Figure 1:
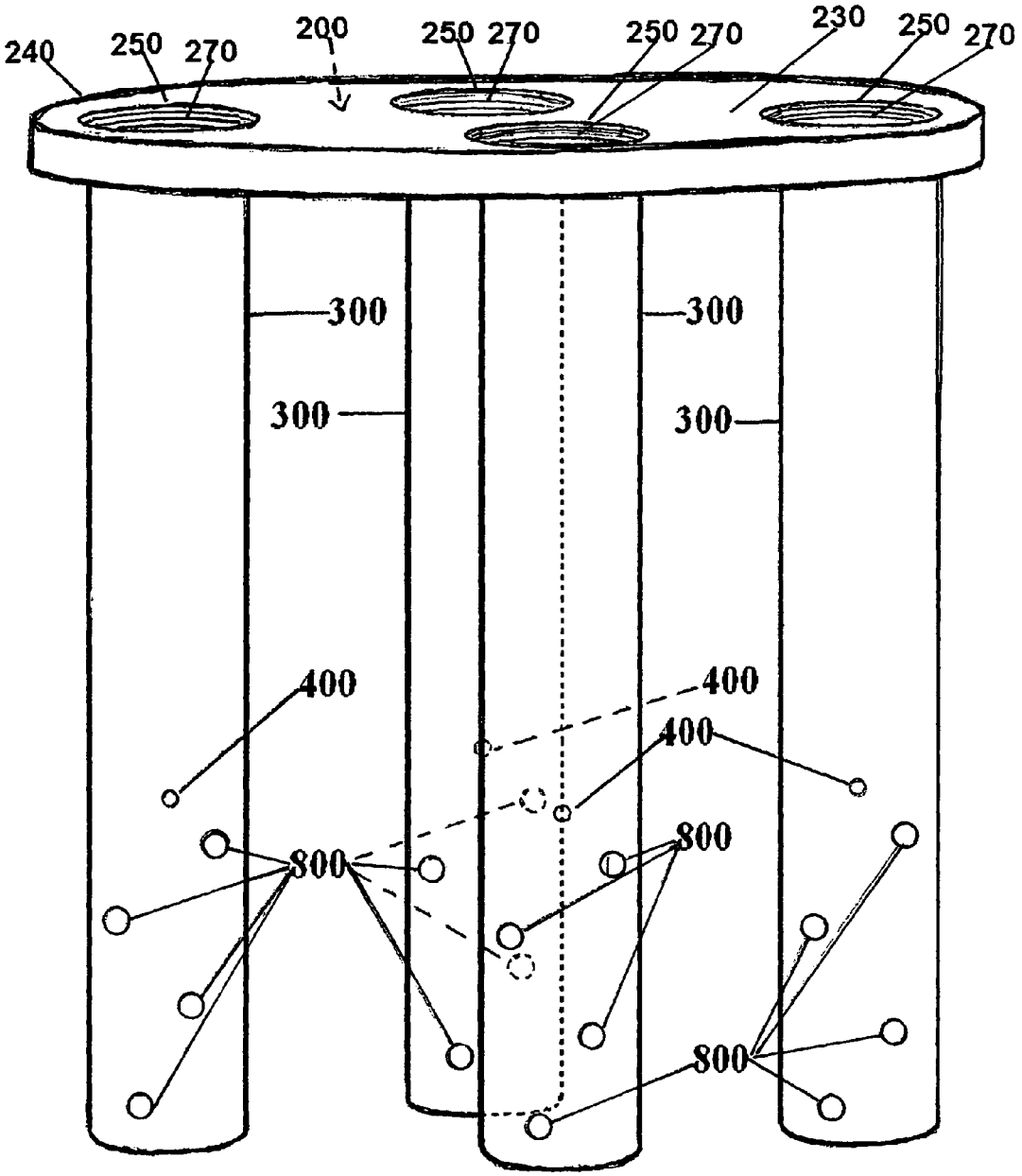
FIG. 1 is a perspective view of one embodiment illustrating the golf club holder.

200 base
230 surface
240 edge
250 plurality of openings
270 female thread
280 underside
300 tubular casing
350 male thread
400 pin
500 shaft
700 wall of tubular casing
800 plurality of holes

DETAILED DESCRIPTION OF THE INVENTION

The embodiments discussed herein are merely illustrative of a preferred embodiment in which to make and use the invention and are not to be interpreted as limiting the scope of the present invention.

Figure 7:
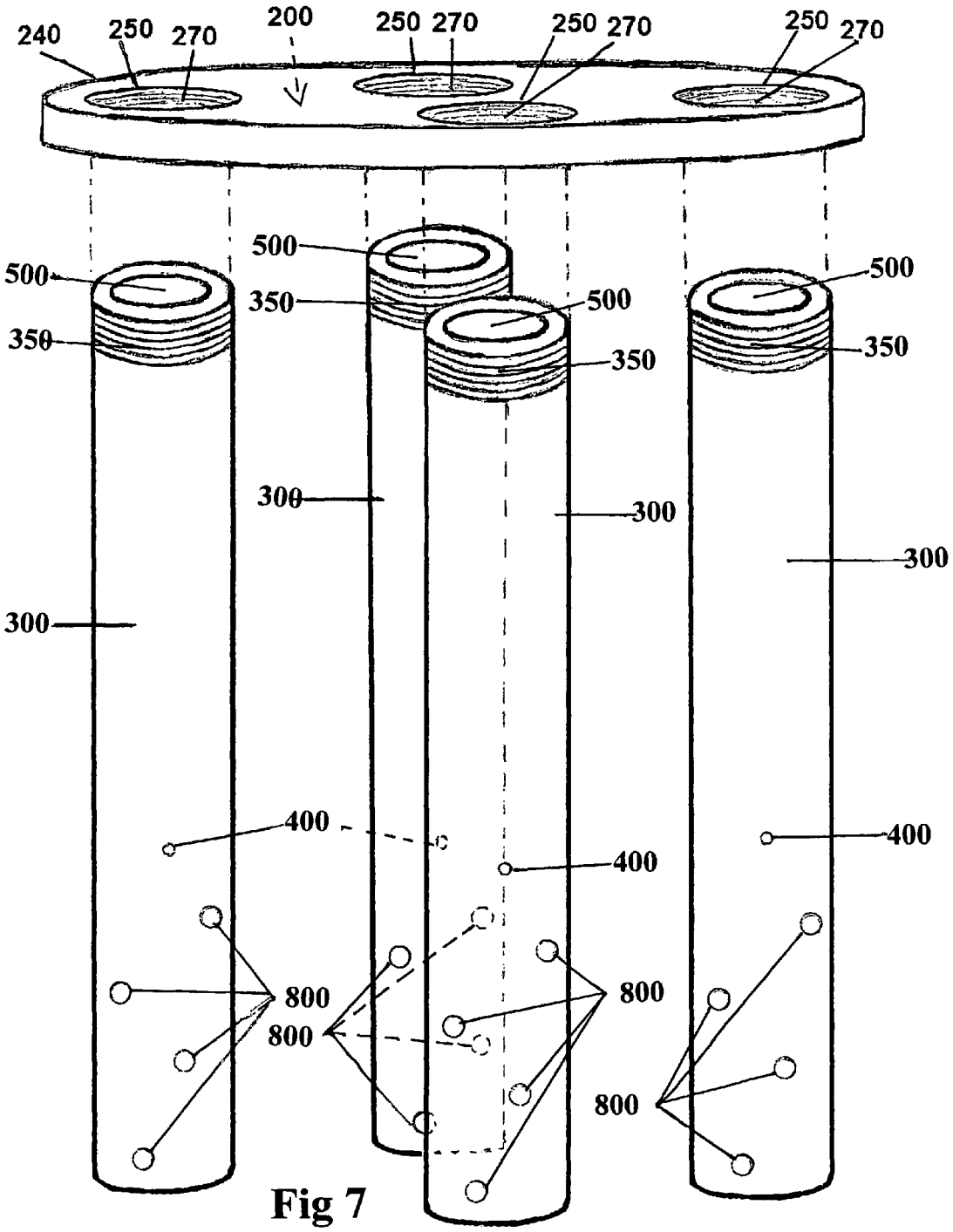
FIG. 7 is an illustrative view of tubular device with base.

FIG. 1 shows an overall view of the preferred embodiment. The golf club holder apparatus comprises three material parts: a base 200, a tubular casing 300, and a pin 400. For the preferred embodiment, the apparatus comprises the base 200, four tubular casings 300, and four pins 400 (FIGS. 1 and 7).

Figure 2:
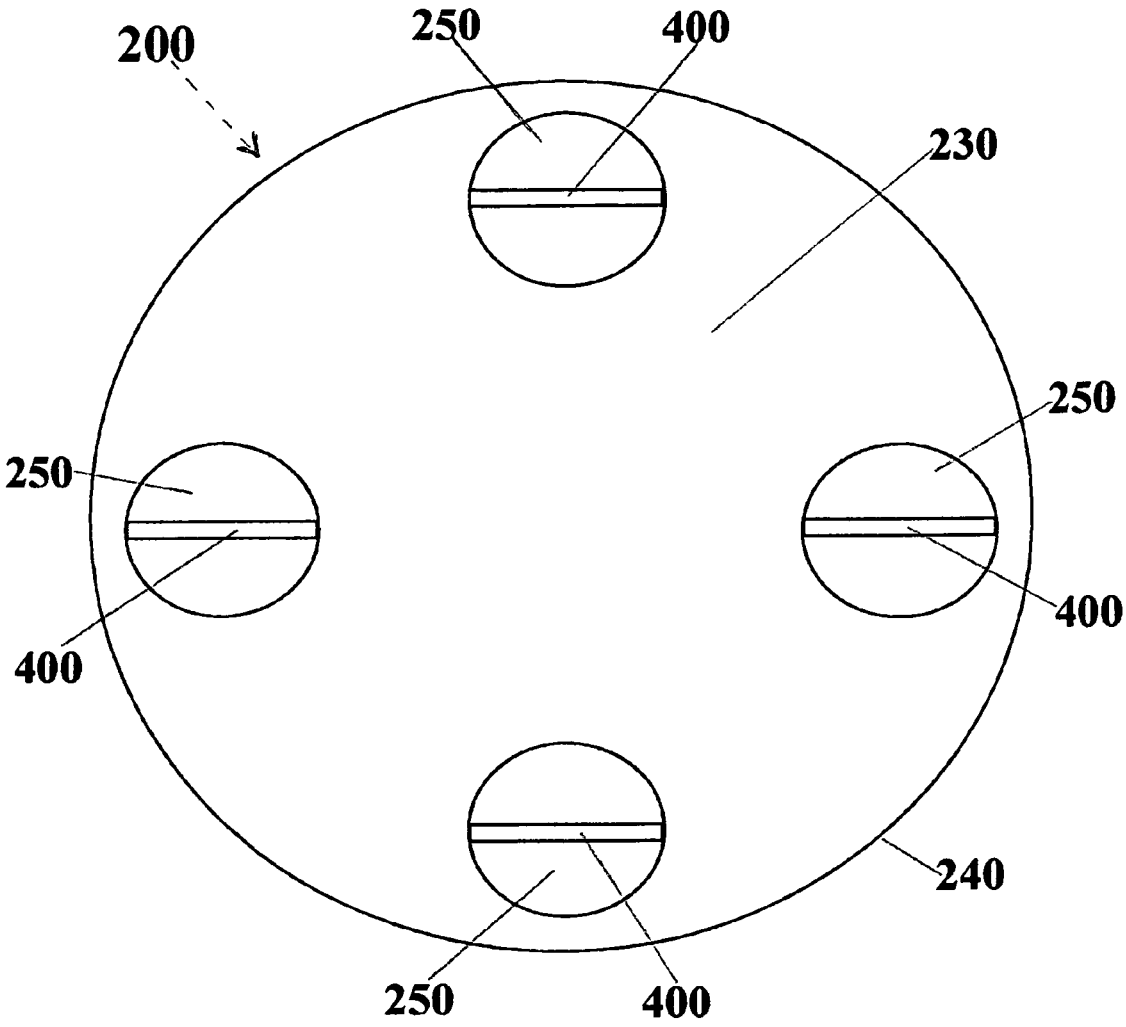
FIG. 2 is an above view of the base showing pins in plurality of openings.
Figure 3:
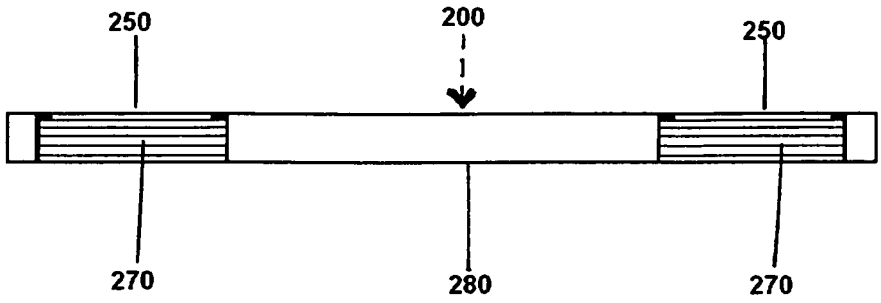
FIG. 3 is a cross sectional view of the base showing female thread of plurality of openings.

In FIG. 2, the base 200 is comprised of a surface 230, an edge 240, a plurality of openings 250, and a female thread 270 (FIG. 3). The material of the preferred embodiment for the base is a plastic plywood sheet known as StarBoard. StarBoard is used in the marine industry and withstands harsh outdoor environments. Specific attributes of StarBoard that are essential to the preferred embodiment include: made of the finest polymers available for superior flatness and consistency; environmentally stabilized for harsh sun and tough outdoor environments; will not rot, swell, splinter or delaminate when exposed to humidity or water; precise tolerances ensure consistent color, thickness and density; easy to fabricate with standard woodworking tools and requires little or no finishing; available in eight standard colors, with unlimited customize colors; durable matte-textured surface on both sides; easy to clean and never needs refinishing; edges finish cleanly, and forms easily for smooth curves. These attributes are necessary for the material of the preferred embodiment to withstand conditions of: moisture from rain, dew, and sprinklers, heat, cold, humidity, sun ultraviolet-rays, weight of golf maintenance equipment, wear and tear of golfers utilizing the holder, and easy of cut for variations in design and cost savings from less waste.

For the preferred embodiment, a Starboard sheet of 54" width×96" length with depth of 0.50 inches has been chosen. FIG. 2 and FIG. 3 show the design of a base as a circular unit of 7 inch diameter and depth of 0.50 inches cut out of the StarBoard sheet. In a two-step process, the base 200 is drilled to create a plurality of openings 250 (FIG. 2). The first drilling of the base 200 creates the plurality of openings 250 of 0.50 inch in depth and with diameter of 1.38 inches (FIG. 3). The plurality of openings 250 are drilled so that each is 0.35 inches from an edge 240 of the base 200 (FIG. 2). The plurality of openings 250 are spaced equal distanced away from the center of the base 200 along the center axis of the base 200 (FIG. 2). There are 5 inches from the center point of the plurality of openings 250 diagonally across the base 200 to the next center point 260 (FIG. 2). The preferred embodiment has the plurality of openings 250 positioned towards the edge 240 (FIG. 2) for the marketing purpose of having an open area on a surface 230 of the base 200 for engraving golf course name or logo.

Figure 4A:
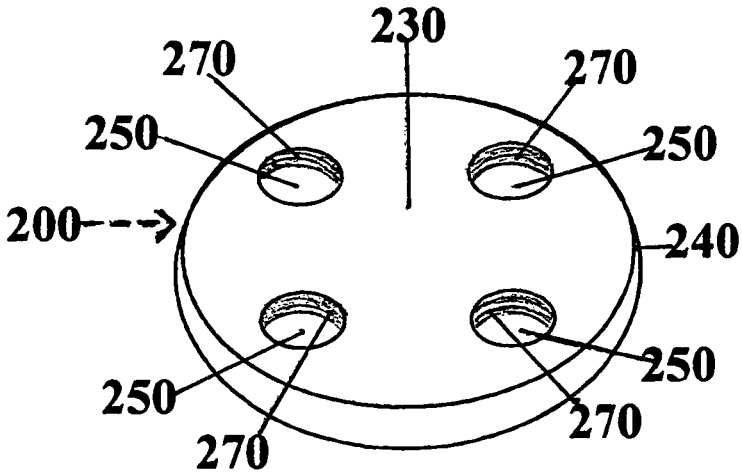
FIG. 4A and FIG. 4B are perspective views of base from above and below respectively.
Figure 4B:
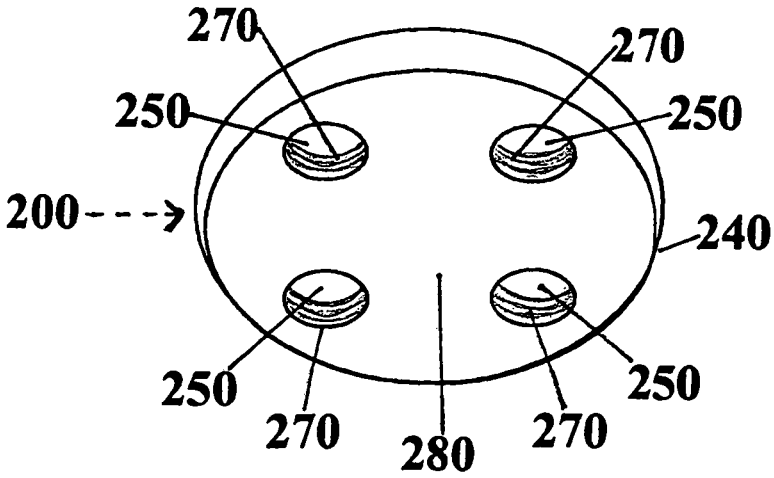

A second drilling of the base 200 is a standard NPT female thread 270 cutting into the base 200 at each of the plurality of openings 250 (FIGS. 3, 4A and 4B). For the second drilling, starting from the underside 280 of the base 200, at the plurality of openings 250, the base 200 is drill for 0.44 inches of the 0.50 inch depth of the base 200 (FIG. 3). The remaining depth of 0.06 inches of base 200 is not drilled (FIG. 3). This second drilling, which creates the female thread 270, increases the diameter of the plurality of openings 250 from 1.30 inches to 1.66 inches for the lower 0.44 inches of the base 200. Therefore, for the preferred embodiment, the plurality of openings in a base 200 are 1.38 inches in diameter for the initial 0.06 inches with no threading and 1.66 inches in diameter for the lower 0.44 of depth with female thread 270 (FIG. 3).

In the preferred embodiment, a tubular casing 300 is attached at each plurality of opening 250 of the base 200 from the underside 280, as shown in FIGS. 1 and 7. With regard to the material of a tubular casing 300, the preferred embodiment is Schedule 40 polymerized vinyl chloride (PVC). PVC is inexpensive, durable, water resistant, high in strength, light weight, easy to assemble, and has the capability to be molded to specific shape and size.

With regard to the design of a tubular casing 300 (FIG. 5), the preferred embodiment is 1¼' Schedule 40 PVC pipe with length of 12 inches. A wall 700 of a tubular casing 300 has 0.14 thickness. From the top of a tubular casing 300, the initial outer 0.50 inch is threaded into a standard NPT male thread 350. Moving up from the bottom of a tubular casing 300, at the 4.25 inch mark, a 3/16 hole is drilled into each opposite wall of a tubular casing 700 to accommodate insertion of the above mentioned pin 400. Again, starting from bottom of a tubular casing 300 and up to the 4 inch mark, a plurality of holes 800 of diameter 5/16 inches are drilled into a tubular casing 300. The plurality of holes 800 are random in location and number throughout the bottom 4 inches of a tubular casing.

Each tubular casing 300 is attached to the base 200 from the underside 280 (FIGS. 1 and 7). In the preferred embodiment (FIG. 7), the tubular casing 300 with male thread 350 is screwed into the base 200 with female thread 270 at the plurality of openings 250. The tubular casing 300 is screwed into the underside 280 of the base 200 for 0.44 inches as that is the length of the female thread 270, as mentioned above. The base 200 and the attached tubular casing 300 now create a shaft 500 at each plurality of openings 250 in the apparatus (FIG. 7).

Figure 5:
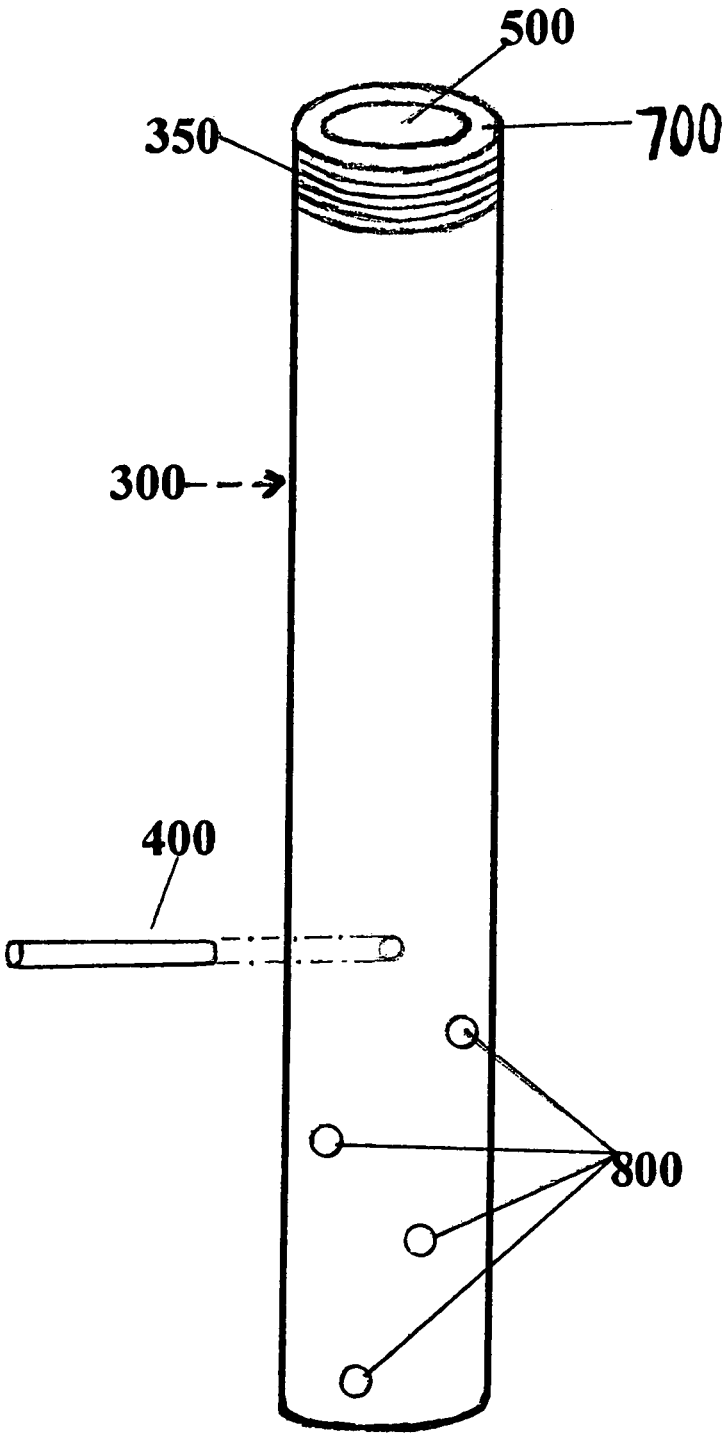
FIG. 5 is a side view of a tubular casing.

As mentioned above, a pin 400 is inserted into a tubular casing 300 (FIG. 5). With regard to the material of the pin 400, the preferred embodiment is a Stainless Steel round 316 annealed rod. The attributes of this material include high strength, excellent resistance to corrosion, easy to cut, and inexpensive.

Figure 6:
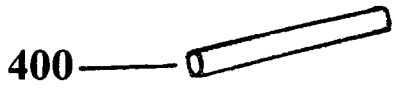
FIG. 6 is a side view of a pin.

With regard to the design of the pin 400 (FIG. 6), the preferred embodiment is 3/16 inches in diameter and 1.66 inches in length. As mentioned above, the pin 400 is inserted into each tubular casing 300 at a mark of 4.25 inches up from the bottom of the tubular casing 300 (FIG. 5). Again, as mentioned above, for placement of the pin 400, a 3/16 inch hole is drilled into the wall 700 and straight through the adjacent wall 700 of the tubular casing 300. The pin 400 is inserted into that drilled hole of the tubular casing 300 and extended straight across the shaft 500 into the adjacent wall of the tubular casing 300. The pin 400 length of 1.66 inches is equivalent to the tubular casing 300 inside diameter of 1.38 plus 0.14 inch thickness per wall 700 of the tubular casing 300. Therefore, when fully inserted, the pin 400 is flush with each wall 700 of the tubular casing 300. Due to the tight fit of the pin 400 into the drilled holes of wall 700 of the tubular casing 300, the pin 400 is secured into the wall of the tubular casing 300 by tapping the pin 400 in with a hammer. Additionally, the pin 400 is designed to be flush with the wall 700 of tubular casing 250 so that the pin 400 will not deter with the apparatus being place in the ground as an immobile structure fixed below the ground-level by the compression of the ground. FIG. 2 shows a view from above the base 200 of the pins 400 inserted across the shaft 500 of each tubular casing 300.

FIG. 4A and FIG. 4B are perspective views of the base 200 showing the plurality of openings 250 with the female thread 270. FIG. 4A is the perspective view from above and FIG. 4B is the same view from below.

FIG. 7 is an illustrative view of golf club holder demonstrating the relationship of the tubular casings 300 to the underside 280 of the base 200.

OPERATION OF THE INVENTION

Although those of ordinary skill in the art will readily recognize many alternative embodiments, especially in light of the illustrations provided herein, this detailed description is exemplary of the preferred embodiment of the present invention, the scope of which is limited only by the claims appended hereto.

First and foremost, to clearly conceptualize the embodiment, it must be understood that the embodiment is designed to be installed in the ground as an immobile structure on a golf facility. The embodiment can be placed anywhere on the golf facility—including, but not limited to, practice facilities, driving ranges, putting greens, tee boxes, sand trap, and greenside areas.

When installed in the ground by golf course personnel, the surface 230 (FIG. 2) of a base 200 will reside just below the ground level for a golfer to utilize. With the function of the apparatus being to hold a golf club, the base 200 is the opening for the golf club to enter the apparatus. Operationally, with the base 200 having a plurality of openings 250, a golfer can insert the butt of a golf club into one of the plurality of openings 250.

FIGS. 4A and 4B show in the preferred embodiment, the base 200 containing four plurality of openings 250 with female threads 270. The function of the female threads 270 of the base 200 is to accept or provide an attachment to the male thread 350 of the tubular casings 300. The attachment of the tubular casings 300 to the base 200 creates four shafts 500 (FIG. 7). By design, each created shaft 500 is one continuous flush unit of base 200 and tubular casing 300 that allows the butt of a golf club to move down the shaft 500 without interruption. The function of the shaft 500 is to house the golf club. The golfer now with ease can insert the butt of a golf club through one of the plurality of openings 250 in the base 200 and slide the butt of the golf club down through the shaft.

As seen in FIG. 2, the preferred embodiment has a pin 400 inserted across the shaft 500 of each of the tubular casing 300. The function of the pin 400 is for the butt of the golf club to rest upon. The butt of the golf club will freely slide down through the shaft 500 of a tubular casing 300 for 7.75 inches until it reaches a pin 400 and comes to rest. Operationally, this will keep the butt of the golf club from reaching the ground and therefore free of dirt. Operationally, the butt of the golf club is now resting upon a pin 400 and standing vertically within the shaft 500 of the golf club holder apparatus.

As seen in FIG. 7, a tubular casing 300 has a plurality of holes 800 from the bottom of the tubular casing 300 and up 4 inches. The function of the plurality of holes 800 in the tubular casing 300 is to allow water to drain from the shaft 500 through the wall 700 of the tubular casing 300. In addition, the tubular casing 300 is hollow allowing water to drain.

Description—Alternative Embodiment

With regard to materials, as mentioned above, the preferred embodiment material for a base 200 is Starboard and a tubular casing 300 is Schedule 40 PVC. Alternative embodiments for both parts can include any material that will withstand the rigors of being a outdoor structure. The material must therefore be water resistant, flexible to withstand severe temperatures, and rigid to withstand heavy equipment and wear and tear from users. A wide variety of plastics and plastic blends are available that will perform similarly to Starboard and PVC, respectively. In addition, plastics and plastic blends are available in color and multi-color for creative marketing possibilities such as engraving on the base. It is not advised to use wood due to moisture issues or metals due to lightning strikes.

With regard to materials, as mentioned above, the preferred embodiment material for a pin 400 is stainless steel. Stainless steel has been selected for the materials' strength and corrosion resistance. Alternative embodiments for a pin 400 can include any material that will withstand the rigors of being a outdoor structure. The material must therefore be water resistant and flexible to withstand severe temperatures. A wide variety of steel alloys and plastics will perform similarly to stainless steel.

With regards to design, as mentioned above, the preferred embodiment design of a base 200 is a circle with a 7 inch diameter, a depth of 0.50 inches, and containing a plurality of openings 250 with a 1.38 diameter. For the purpose of being a golf club holder, a base 200 can alternately be of any shape and size as long as a plurality of openings 250 is of size to accept the butt of a golf club. However, it is suggested to refrain from an opening of size larger than a golf ball so as to not have a golf ball fall into a shaft 500. With that being said, a base 200 can be square, rectangular, oval, and any decorative shape for marketing purposes. The depth of a base 200 alternatively is restricted only by the ability of attaching a tubular casing 300 to the base 200. The preferred embodiment base 200 has four openings as a plurality of openings 250. The number of openings is limited only by the shape and size of a base 200 and the size of the said plurality of opening 250. In addition, the location of the said plurality of openings 250 on the base 200 has no limitations. For marketing purposes, a plurality of openings 250 could be moved to the center or placed in a straight line. The preferred embodiment contains a base 200 with female thread 270 at the plurality of openings 250 for attaching male thread 350 of tubular casings 300. Alternatively, these tubular casing 300 can be attached to the base 200 in any manner including but not limited to epoxy, nails, tacks, and solder.

With regards to design, as mentioned above, the preferred embodiment design is a 12 inch tubular casing 300 with a width of 1.66 inches. For the purpose of being a shaft 500 to allow a butt of a golf club to slide down, the tubular casing 300 can be of any length long enough to allow golf club to stand vertically. In addition, as mentioned above, the diameter of a tubular casing 300 is restricted only by the ability of a butt of a golf club to enter. Again, it is advised not to utilize a tubular casing 300 with a diameter larger than a golf ball. Regarding a plurality of holes 800 in each tubular casing 300 to drain water, the size and number of plurality of holes 800 have no limits.

With regards to design, as mentioned above, the preferred embodiment design of a pin 400 is 3/16 inch round in diameter and 1.66 inch in length. The shape and design of the pin 400 is only limited by its capability of crossing the shaft 500. As the function of the pin 400 is for a butt of a club to rest upon, it can be of any shape and size. The location of the pin 400 also is only limited by a butt of the golf club resting on the pin and allowing the golf club to stand vertically.

Operation—Alternative Embodiment

With regards to functionality, alternative design or material should not deter from the ease of use for a golfer to insert butt of a golf club into a plurality of opening 250 of a base 200 and allowing the golf club to slide down shaft 500 until it rests upon a pin 400 standing vertically.

Advantages

From the description above, a number of advantages of our golf club holder become evident:

a. an immobile golf club holder apparatus fixed below the ground-level by the compression of the ground will reduce the need for a golfer to carry a golf club holder as part of their golf equipment in their golf bag.

b. an immobile golf club holder apparatus fixed below the ground-level by the compression of the ground will reduce the need for a golfer to setup a golf club holder device on a golf course c. an immobile golf club holder apparatus fixed below the ground-level by the compression of the ground will reduce the fatigue of a golfer by reducing the number of golf clubs a golfer needs to bend and pick up from the ground.

d. an immobile golf club holder apparatus fixed below the ground-level by the compression of the ground is available to all golfers not just to golfers that own their own devices.

e. an immobile golf club holder apparatus fixed below the ground-level by the compression of the ground will reduce the need for a golfer to purchase a golf club holder device.

CONCLUSION, RAMIFICATIONS, AND SCOPE

Accordingly, the reader will see that at least one embodiment of the golf club holder provides a more reliable apparatus as an immobile apparatus, an apparatus free of danger from any sharp mechanisms, an apparatus free from any labor necessary to set up, an apparatus free from having to be carried in golf bag, an apparatus reducing the energy of bending to pick up golf clubs, an apparatus that is of no economic consideration to a golfer, and an apparatus that is available for utilization by all golfers. Our design has an advantage in ease of functionality for golf club holder apparatus. A golfer simply needs to slide the butt of a golf club into a base 200 and allow the club to slide down the shaft 500 of a tubular casing 300 until the butt rests upon a pin 400.

While this golf club holder invention contains many specificities, these should not be construed as limitations on the scope of any embodiment, but as exemplifications of the presently preferred embodiment thereof. Many other ramifications and variations are possible. Thus the scope of the invention should not be determined by the embodiment illustrate, but by the appended claims and their legal equivalents.

The invention claimed is:

1. An apparatus embedded in the ground for holding golf clubs, said apparatus comprising:

a base located at or below ground level and having a plurality of openings extending through the base from a topside to an underside to allow insertion of a butt of a golf club into one of the plurality of openings of the base;

a plurality of tubular casings, each tubular casing having a threaded end and a non-threaded end, wherein each of said plurality of tubular casings are adapted to house a golf club;

each tubular casing being attached to said base at one of said plurality of openings at said threaded end, wherein each tubular casing extends from said underside of said base such that the exterior of each of the plurality of tubular casings is not visible from above ground;

each of said plurality of tubular casings having a plurality of transverse holes in walls thereof and a pin above said plurality of transverse holes, said transverse holes allowing draining of water;

whereby a golfer can slide a butt of a golf club into one of the openings in the base and down one of the tubular casings to rest on a respective pin so that the golf club is retained to stand in a substantially vertical position.

* * * * *